United States Patent [19]

Dundon et al.

[11] 4,254,955

[45] Mar. 10, 1981

[54] GAME TIMER APPARATUS

[76] Inventors: Carl M. Dundon, 637 Beacon Square Dr., Holiday, Fla. 33590; Cletus Israels, 10535 Shaver Rd., Portage, Mich. 49081

[21] Appl. No.: 37,702

[22] Filed: May 10, 1979

[51] Int. Cl.[3] ..... A63F 3/06

[52] U.S. Cl. ..... 273/148 R; 273/144 A; 368/3; 368/109

[58] Field of Search ..... 273/144 R, 144 A, 144 B, 273/148 R; 200/61.1, 61.11; 58/145 D; 368/3, 108, 109

[56] References Cited

U.S. PATENT DOCUMENTS

| | | | |
|---|---|---|---|
| 526,760 | 10/1894 | Thompson . | |
| 2,070,683 | 2/1937 | Price . | |
| 2,419,836 | 4/1947 | Holbrook . | |
| 2,684,246 | 7/1954 | Soroka | 273/54 R UX |
| 3,934,881 | 1/1976 | Goldfarb | 273/110 |
| 4,021,036 | 3/1977 | Nelson et al. | 273/29 A |

*Primary Examiner*—Anton O. Oechsle

*Attorney, Agent, or Firm*—Blanchard, Flynn, Thiel, Boutell & Tanis

[57] ABSTRACT

A bingo game timer apparatus for cooperation with a device capable of supplying bingo indicia carrying articles, such as balls, one after the other along a path, to assist the bingo game operator in calling out bingo indicia to be played. The timer apparatus includes a limit switch having an actuator positioned for actuation by a ball moving along the path. A timer responds to actuation of the limit switch for timing an interval adjustable to be sufficient for the operator to call out, and the players to play, the bingo letter and number on a given ball. Signal lamps alternately respond to the state of the timer for signaling the occurrence of the interval to the operator.

9 Claims, 3 Drawing Figures

GAME TIMER APPARATUS

FIELD OF THE INVENTION

This invention relates to a game timer apparatus, particularly for bingo games.

BACKGROUND OF THE INVENTION

Bingo is a long popular and widely played games familiar to most people. Basically the game is played on cards divided into squares, the majority of squares each being identified by its own letter-number combination (e.g. B-9, I-36, etc). Different cards have differently identified squares. The game operator calls out the series of randomly selected letter-number combinations. Each player puts a marker on any square identified by the then called letter-number combination, on any of his cards. Achieving a predetermined pattern of markers on a card wins the game.

Charitable, civic and the like groups commonly stage bingo games as fund raisers open to the public. A typical group-sponsored bingo evening may draw several hundred people, many of whom simultaneously play several bingo cards. For the convenience of the game operator and to assure random selection of the letter-number combinations, various letter-number selecting mechanisms have been used in such bingo contests. Commonly, each letter-number combination is printed on an article such as a Ping-Pong ball, the balls are tumbled in an enclosure, continously, by an air blower. The air flow out of the ball exit tube carries such balls and randomly delivers one at a time upon demand to the game operator who then calls out the letter-number combination thereon.

In games of this type it is difficult to maintain the proper pace in calling out letter-number combinations as the game continues. On the one hand, both the players and operator want the letter-number combinations called out rapidly enough to permit playing of a certain minimum number of games in the course of the available time. On the other hand, sufficient time must be allowed after calling out such letter-number combination for a person of moderate skill to scan and mark a reasonable number of cards. While these two requirements conflict to an extent, random variations in the amount of time allowed between calls insure that neither requirement will be satisfied and may leave the players alternately bored and unable to complete marking of the cards. Yet such randomness in the call interval normally results when the game operator relies on his own "mental clock" as to the time between calls. On the other hand, it is inconvenient, and normally not very reliable to require the human operator to use his wristwatch or a wall clock to determine when to call out the next number, particularly when he is also occupied with operating the ball delivery machine, watching the players, etc.

SUMMARY OF THE INVENTION

Accordingly, it is an object of this invention to provide a timer apparatus automatically actuable by discharge of a bingo indicia carrying ball for timing a preselectable interval, sufficient for calling out and playing the particular bingo letter-number combination presented, and for informing the operator of the beginning and end of such interval, and thereby for assisting in maintaining a reliable pace in calling out bingo letter-number combinations.

A further object is to provide such an apparatus at relatively low cost and which is readily adaptable to commonly used bingo ball supply machines.

Other objects and purposes of this invention will be apparent to persons acquainted with apparatus of this general type upon reading the following specification and inspecting the accompanying drawings.

The objects and purposes of the invention are met by providing a bingo game timer apparatus for cooperation with a device capable of supplying bingo indicia carrying articles, such as balls, one after the other along a path, to assist the bingo game operator in calling out bingo indicia to be played. The timer apparatus includes a limit switch having an actuator positioned for actuation by balls moving along the path. A timer is responsive to actuation of the limit switch for timing a preselected interval sufficient for the operator to call out and the players to play, the bingo letter and number combination on a given ball. Signal lamps alternately respond to the state of the timer for signaling the occurrence of the interval to the operator.

DETAILED DESCRIPTION

Figure 1:
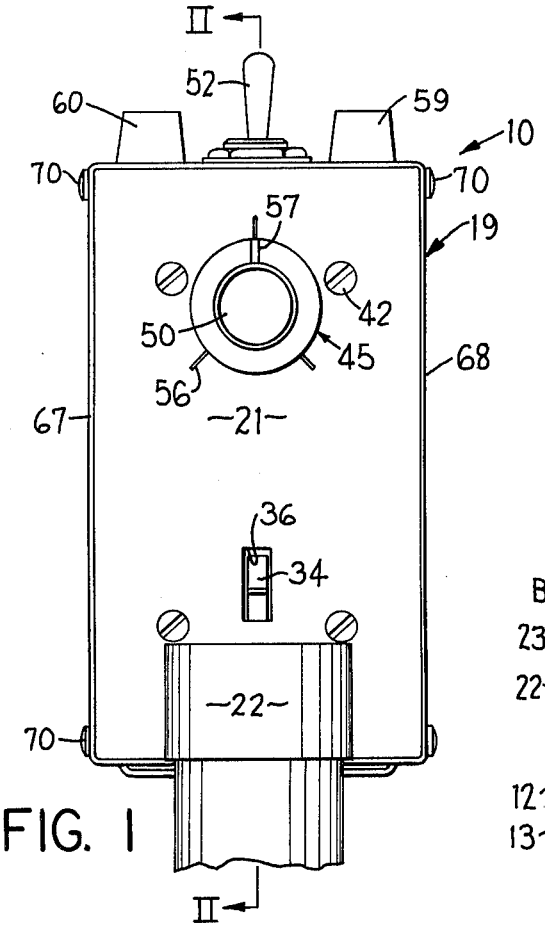
FIG. 1 is a front view of an apparatus embodying the invention shown supported on the output tube of a conventional random indicia supply.
Figure 2:
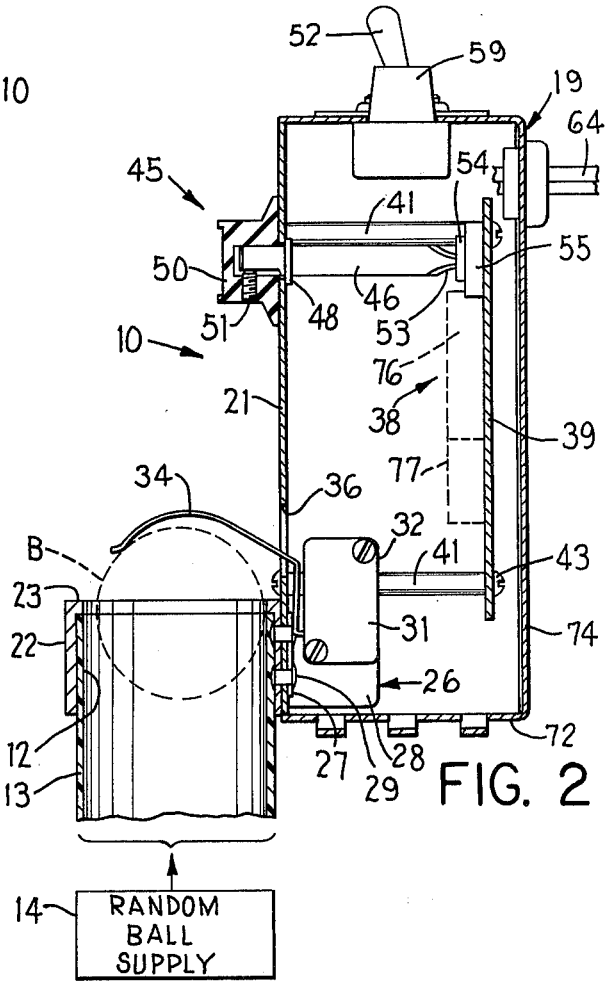
FIG. 2 is a central cross sectional view substantially taken on the line II—II of FIG. 1.

Turning to FIGS. 1 and 2, the bingo game timer apparatus 10, embodying the invention, in use is normally fixed along the path of indicia bearing articles forwarded one at a time from a suitable supply. Typically, the inventive apparatus 10 may be supported on the outlet end portion 12 of the ball outlet tube 13 of a conventional random ball supply 14. Such random ball supplies have long been used in bingo games open to the public and typically take the form of an enclosure containing a plurality of Ping-Pong balls each imprinted with its own bingo letter-number combination. The person operating the bingo game, herein referred to as the operator, manually pulls a randomly selected ball from ball outlet tube 13, on the random ball supply 14. The random ball supply arrangement 12–16, being conventional, does not require further description.

A ball B is ejected from supply 14 as shown in dotted lines in FIG. 2 and is held at outlet end 12 by trigger leaf 34 (hereafter described) and air flow through tube 13, until operator pulls ball B from outlet end 12 of tube 13, causing a conventional microswitch to be tripped as hereafter discussed.

Turning now to the apparatus 10 more specifically embodying the invention, same comprises a boxlike housing 19 (FIGS. 1 and 2) having a front face 21 secured at one end to a collar 22 provided for mounting housing 19 on end 12 of ball supply tube 13. In the particular embodiment shown, the tube 13 is upstanding and opens upward with collar 22 closely sleeved thereover and having a narrow, radially inward extending flange 23 overlying the end of tube 13. Collar 22 conveniently may be a removable sliding fit over the upper end of the tube. However, the collar 22 may be more fixedly secured, as with a set screw (not shown), where the tube 13 extends and opens sidewardly or downwardly. The inside diameter of flange 23 preferably is similar to that of tube 13 so as not to obstruct normal ejection of balls B from the tube. The hand of the operator is normally positioned adjacent the end of the tube to pull each ball, for calling out the bingo indicia thereon.

A limit switch bracket 26 is L-shaped as seen from the top, having an upstanding base 27 carrying a rightwardly extending switch support flange 28. As seen in FIG. 2, the bracket base 27, the lower central portion of housing face 21, and the opposed periphery of collar 22 are preferably fixed together in sandwiched relation, here by rivets 29, to fixedly support housing 19 on collar 22.

A conventional, normally closed limit switch 31 is fixed to rearward extending bracket flange 28 by screws 32. Limit switch 31 has a modified trigger leaf 34 which extends forward (leftward in FIG. 2) from the limit switch through a slot 36 in the front wall 21 of housing 19 into the path of balls B emerging from tube 13, so as to open normally closed limit switch 31 each time a ball B is removed from tube 13. To permit a ball B to be removed from the end of the tube 13, trigger leaf 34 is spaced axially beyond the tube end by about the radius of such a ball B and is elongate and springlike so its free end will deflect out of the way of the ball after actuating switch 31. For high reliability in actuation, trigger leaf 34 lies in a diametral plane of collar 22 and tube 13, and is downwardly concavely curved as seen in FIG. 2, substantially in conformance with the shape of the approaching ball.

Applicant's timer apparatus 10 further includes a timer unit 38, preferably of solid state type and in the preferred embodiment shown being a solid state timer model R16-30A-120A-Y2 manufactured by Potter and Brumfield, having a place of business at Princeton, Indiana.

Such timer unit 38 here comprises a conventional printed circuit board 39 disposed within housing 19 and carrying conventional transistorized timing circuitry generally indicated by a block 76 and including interval adjusting means such as a potentiometer 55 having a movable interval adjusting slug 54. Such timer unit 38 further includes relay contacts generally indicated at 77 and controlled by timing circuitry 76. Board 39 is here supported on and spaced behind front housing wall 21 by horizontally extending, internally threaded spacers 41 secured to front wall 21 and board 39 by axially opposed screws 42 and 43.

An externally adjustable control assembly 45 is conveniently provided on the front face 21 of housing 19 for permitting the operator to adjust the interval timed by timer unit 38. In FIG. 2, control 45 comprises a rotatable shaft 46 located in housing 19 and extending forwardly out through a hole in front housing wall 21 and retained against forward (leftward in FIG. 2) displacement by a conventional snap ring 48 secured in a groove in shaft 46 and bearing against the interior surface of front housing wall 21. An adjustment knob 50 is fixed to the externally exposed end of shaft 46, as by a set screw 51 engaging a flat on the shaft. The interior end of shaft 46 is contoured at 53 to fit into a complementary recess in a rotatably drive timer adjusting slug 54. The shaft end 53 and corresponding recess in slug 54 here are of substantially X-shaped cross section somewhat similar to the cross section of a Phillips-type screwdriver. Manual rotation of knob 50 thus acts through shaft 46 and slug 54 to adjust the length of the interval timed by timer unit 38. The front housing wall 21 here carries circumferentially spaced indicia 56 opposable to a radial index line 57 on knob 50 to indicate the length of interval selected.

Alarm devices are provided to indicate whether the timer unit 38 is timing its interval and, in the preferred embodiment shown, take the form of electric lamp units 59 and 60 of conventional type visible on top wall 71 of housing 19 and extending through suitable openings in such wall for electrical connection interiorly of the housing.

An on-off switch 62 is preferably also mounted on housing top wall 71. Switch 52, knob 50 and lamps 59 and 60 are spaced out of the way of limit switch trigger leaf 34 and the path of the balls B emerging from collar 23, but yet are convenient to the hand and eye of the game operator.

Electric operating potential is supplied to housing 19, here through a conventional AC power cord 64 connectible through a conventional plug (not shown) to a conventional 110 volt AC wall socket. Electric power input of any convenient type and voltage (e.g. 12 volts DC) may be substituted if desired. For easy access to its contents, housing 19 is preferably formed as two components, here a unitary fixed component, including front face 21 and top and bottom walls 71 and 72, and a removable (by release of screws 70) component defining the side and rear housing walls 67, 68 and 74.

Figure 3:
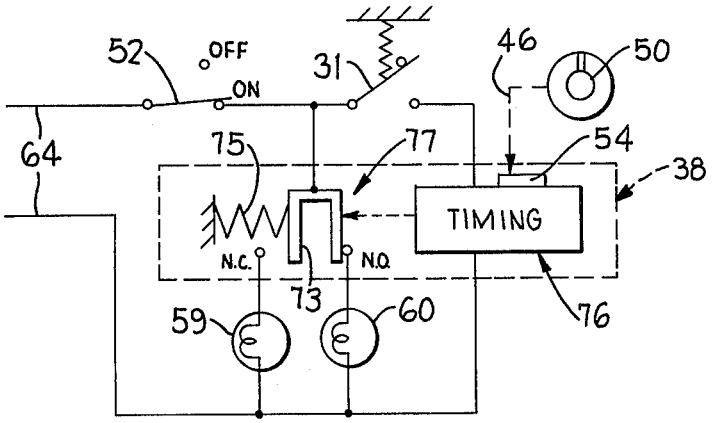
FIG. 3 is an electrical circuit diagram for the apparatus of FIGS. 1 and 2.

In FIG. 3, the switching of relay contacts set 77 is schematically shown, for convenience in illustration, to comprise a switchable contact 73 biased at 75 to close a current path by engaging a fixed contact NO and open another current path by disengaging another fixed contact NC. Timing circuitry 76 is responsive to potential applied thereto for timing a preselected interval and during such timing to reverse the state of said timer switch means 73, NC, NO and thereby break the current path between contacts 73 and NO and make the current path between contacts 73 and NC. While here disclosed as a transistorized timing circuit 76 having an output relay driving mechanical switching 77, it is contemplated that timing unit 38 may take other physical forms, such as an integrated circuit incorporating or driving electronic switching of sufficient power handling capability.

The external electrical connections to the timer unit 38 are as follows: Timing portion 76 connects in series with on-off switch 52 and limit switch 31 across the electrical supply lines 64. To complete the circuit, fixed contacts NC and NO connect respectively through lamps 59 and 60 to one side of electrical power supply lines 64 while switchable contact 73 connects through on-off switch 52 to the other side of electrical supply lines 64.

OPERATION

To ready the apparatus 10 for operation, the operator closes switch 52 to its on position shown in FIG. 3 whereby electric current is supplied through limit switch 31 (in its normally closed position not shown) to timing portion 76, energizing same and igniting lamp 59 by current flow through on-off switch 52 and contact 73. This is the timing condition of the apparatus. At any time the operator may adjust knob 50 circumferentially with respect to time scale markings 56 to preselect the desired timer interval.

In playing the game, each indicia bearing ball B taken by the operator from tube 13 at collar 22, momentarily raises trigger leaf 34 and opens limit switch 31 to its FIG. 3 position. Then, limit switch 31 recloses due to removal of ball B from contact with trigger leaf 34, causing timing portion 76 of timing unit 38 to start timing an interval of selected length, typically an interval in the 2 to 40 second range. Simultaneously with the beginning of timing, such closing of limit switch 31 causes contact 73 to switch to its NC position igniting lamp 59 and continuing its ignition throughout timing of the preselected interval by timing portion 76. It is during this timed interval, marked by continued ignition of lamp 59, that the game operator calls out the bingo letter-number combination on the ball and then allows the players time to play the called letter-number combination.

At the end of the interval, timing portion 76 times out and, with microswitch 31 havng previously closed as above mentioned, shifts back contact 73 to its NO position to extinguish lamp 59 and reignite lamp 60. The operator will normally now respond by pulling ball B from between tube 13 and trigger leaf 34 thereby causing it to trip trigger leaf 34 and once again open and reclose limit switch 31 to start timing a second interval for calling and playing the letter-number combination on the second ball.

In this way, the apparatus 10 allows the operator of the bingo game to visually determine that he is calling out the letter-number combinations at a consistent preselected rate merely by watching lamp 59 and making sure he has read off one letter-number combination during each period that the lamp 59 is ignited. On the other hand, the ignition of lamp 60 informs the operator that the apparatus 10 is in the idle or nontiming condition and at the moment of its ignition positively prompts the operator to manually pull a new ball.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a bingo game apparatus to assist an operator in calling out bingo indicia to be played, the combination comprising:

means for supplying bingo indicia carrying articles one after another along a path to an outlet for removal one at a time by said operator;

limit switch means fixed along said path, said limit switch having a displaceable actuator at least in part blocking said outlet and displaced by each article removed from said outlet by said operator so as to actuate said limit switch means;

timer means responsive to actuation of said limit switch means for timing an interval sufficient for calling out and playing the bingo indicia on said indicia carrying article; and signal means located adjacent said article outlet and responsive to said timer means for signaling the occurrence of said interval to the operator.

2. A bingo game timer apparatus, for cooperation with means supplying bingo indicia carrying articles one after another along a path, to assist the operator in calling out bingo indicia to be played, said bingo game timer apparatus comprising:

limit switch means having an actuator in said path and actuable by said articles moving along said path;

timer means responsive to actuation of said limit switch means for timing an interval sufficient for calling out and playing the bingo indicia on said article;

signal means responsive to said timer means for signaling the occurrence of said interval to the operator; and an article delivery tube extending from the article supplying means and defining said path for delivering said bingo indicia carrying articles, said apparatus including a housing and means supporting said housing on the end of said tube.

3. The apparatus of claim 2, in which said limit switch means is a limit switch, said housing carrying said limit switch adjacent said supporting means with its actuator disposed beyond the end of said tube for actuation by a said article exiting from said tube.

4. The apparatus of claim 2, in which said housing supporting means comprises a collar fitted on the end of said tube and through which successive articles can pass, said housing having a face fixed to the perimeter of said collar and extending axially beyond said collar so as to be visible beyond the end of said tube.

5. The apparatus of claim 4, in which said signal means comprises a lamp carried by said housing to provide a visible display near the point at which said article is retrieved from said collar by the operator.

6. The apparatus of claim 5, including a mounting bracket within said housing and having a base opposed to the periphery of said collar with said housing face sandwiched therebetween, said bracket base, face and collar periphery being fixed together by fastening means, said bracket having a flange extending away from said collar and supporting said limit switch means.

7. The apparatus of claim 4, in which said timer means includes an insulative board fixedly supported in said housing and carrying means for adjusting the interval timed by said timer means, and a manually adjustable member exposed on said housing face and connected to said adjusting means on said timer means to permit manual adjustment of said interval.

8. The apparatus of claim 7, in which said signal means comprises a first lamp visible on said housing face for signaling timing by said timing means, and including an on-off switch on said housing face and actuable to energize the apparatus from an electrical supply, a second lamp visible on said housing face for signaling when the apparatus is connected to said electrical supply through said on-off switch and that said timing means is not timing an interval.

9. A bingo game timer apparatus, for cooperation with means supplying bingo indicia carrying articles one after another along a path, to assist the operator in calling out bingo indicia to be played, said bingo game timer apparatus comprising:

limit switch means having an actuator in said path and actuable by said articles moving along said path;

timer means responsive to actuation of said limit swtich means for timing an interval sufficient for calling out and playing the bingo indicia on said article; and signal means responsive to said timer means for signaling the occurrence of said interval to the operator, said signal means comprising first and second light emitting members, said timer means includes timer switch means with alternately closable first and second current paths therethrough respectively to said first and second light emitting members, an on-off switch, and conductive means for connecting said on-off switch, timer switch means and the selected one of said light emitting members in series with an electrical supply, said limit switch means comprising a limit switch, said timer means further comprising a timing portion actuable to switch said timer switch means from said one to the other of said light emitting members for said timed interval for energization thereof, and further conductive means for connecting said timing portion and limit switch in series with said on-off switch across said electrical supply.

* * * * *